United States Patent [19]

Latona, Jr.

[11] 4,054,002

[45] Oct. 18, 1977

[54] DESICCATING DEVICE FOR FIREARM

[76] Inventor: Carmen J. Latona, Jr., 81½ New Alexander St., Wilkes Barre, Pa. 18702

[21] Appl. No.: 646,374

[22] Filed: Jan. 2, 1976

[51] Int. Cl.[2] ..... F41C 27/08
[52] U.S. Cl. ..... 42/1 N
[58] Field of Search ..... 42/1 N

[56] References Cited

U.S. PATENT DOCUMENTS

| | | | |
|---|---|---|---|
| 540,748 | 6/1895 | Layton | 42/1 N |
| 1,172,746 | 2/1916 | Silverstein | 42/1 N |
| 2,465,163 | 3/1949 | Lockwood | 42/1 N |
| 2,557,277 | 6/1951 | Gibson | 42/1 N |
| 2,983,063 | 5/1961 | Douville et al. | 42/1 N |
| 2,985,979 | 5/1961 | Doyle et al. | 42/1 N |
| 3,593,451 | 7/1971 | McDonnell | 42/1 N |
| 3,708,820 | 1/1973 | Schultea | 42/1 N |
| 3,849,923 | 11/1974 | Hawkins | 42/1 N |

FOREIGN PATENT DOCUMENTS

| | | | |
|---|---|---|---|
| 179,485 | 11/1935 | Switzerland | 42/1 N |

OTHER PUBLICATIONS

Mid-Atlantic Instruments, Inc.; Guns & Ammo p. 21, Jan. 1976.

*Primary Examiner*—Charles T. Jordan
*Attorney, Agent, or Firm*—David A. Tamburro

[57] ABSTRACT

A desiccating device for preventing corrosion within the barrel of a firearm includes a moisture pervious tube filled with moisture absorbing desiccant material. The tube extends the full length of the gun barrel, with its inner end being plugged and extending into the firing chamber. A cap is mounted on the outer end of the tube, and includes attachment means such as a permanent magnet to hold the tube in place and close the muzzle end of the barrel. The device also provides a safety feature, since the inner end of the tube prevents accidental placement or storage of a live bullet within the firing chamber.

10 Claims, 3 Drawing Figures

DESICCATING DEVICE FOR FIREARM

BACKGROUND OF THE INVENTION

This invention relates generally to rust preventing devices for the bore of the barrel of a firearm, and more particularly to a novel desiccating device which may be adapted for use with different sized firearms and which simultaneously prevents the formation of rust within the bore of a firearm barrel and the accidental placement of storage of a bullet within the firing chamber.

The prior art is replete with various type devices intended to reduce the formation of rust and other forms of corrosion caused by the presence of moisture within the bore of the barrel of a firearm. Examples of typical prior known devices are shown in U.S. Pat. Nos. 2,983,063; 2,985,979; 3,708,820; and 3,849,923. However, none of the prior devices has been entirely satisfactory and the need exists for an economical, versatile, effective device for removing moisture from the entire length of the bore of the gun barrel and the firing chamber.

OBJECTS AND SUMMARY OF THE INVENTION

Accordingly, a primary object of the invention resides in the provision of a novel, versatile, economical tubular type desiccating device for placement within the bore of the barrel and firing chamber of a firearm, whereby the device simultaneously prevents the formation of rust and other forms of corrosion within the barrel and the inadvertent placement or storage of a bullet in the firing chamber.

Another object of the invention resides in the provision of a novel desiccating device for a firearm comprising a moisture pervious tube filled with desiccant material and adapted to extend through the bore of the barrel into the firing chamber. The outer end of the tube fits within a cap which includes attachment means such as a permanent magnet which is attracted to the muzzle end of the barrel, thereby retaining the tube in place within the barrel.

Still another object of the invention resides in the provision of a desiccating device as described in the above objects, wherein the inner end of the tube is provided with a removable closure means such as a plug and wherein the tube is constructed of a material which may be readily severed so that the tube may be cut to any desired length and adapted for use with firearms of different sizes.

A further object of the invention resides in the provision of a novel desiccating device for use with a firearm which affords the following advantages:

1. Eliminates moisture build up inside the barrel;
2. Prevents rust formation;
3. Prevents pitting and corrosion normally caused by acid formation;
4. Seals the muzzle of any gun from dust, grit, and grime;
5. Eliminates inaccurate "wet shots" caused by over oiling;
6. Lasts virtually forever with no need to replace it; and
7. Prevents the accidental loading or storage of a bullet within the firing chamber.

Other objects and advantages will become apparent from reading the following detailed description of the invention wherein reference is made to the accompanying drawings in which like numerals indicate like elements.

DETAILED DESCRIPTION OF THE INVENTION

Figure 3:
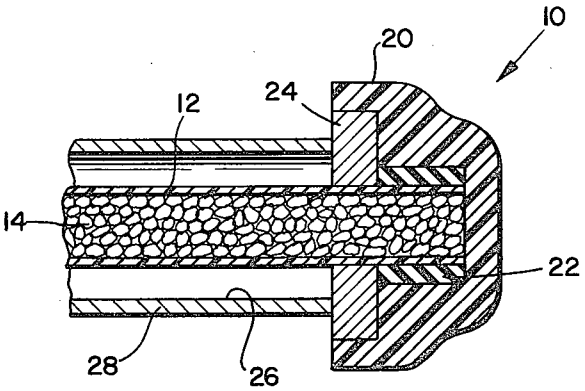
FIG. 3 is a sectional view taken generally along Line 3—3 of FIG. 1 and illustrating the cap structure on the outer end of the desiccant tube.
Figure 2:
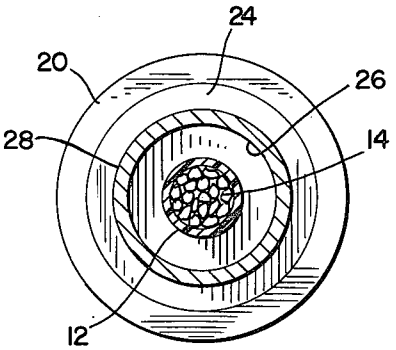
FIG. 2 is a cross sectional view taken along Line 2—2 of FIG. 1.

Referring now to the drawings, the desiccating device 10 of the invention comprises an elongated, transparent, moisture pervious, tubular member 12 filled with a moisture and other vapor absorbing material 14. Inner end 16 of member 12 is provided with a removable closure such as a plug 18. A removable cylindrical plastic cap 20 fits over the outer end of tube 12 and, as shown in FIG. 3, includes a rubber bushing 22 which frictionally grips the outer end of the tube. A permanently magnetized, rustproof washer 24 is fixed within cap 20 in surrounding relation with tube 12.

Tube 12 may be constructed of any suitable moisture pervious material, but preferably is formed from a cellulose material, e.g., cellulose buterate tubing through which moisture and other vapors may pass. The tube has sufficient strength and rigidity to substantially retain its shape and form throughout its length. However it is sufficiently soft so that it may be cut at either end to any desired length. In addition, if necessary a plurality of minute holes may be drilled or otherwise provided through the wall of tube 12 to enhance the passage of moisture into material 14.

The desiccant material 14 may be of any known suitable type and form such as those described in the prior patents noted hereinabove. Preferably, it is of particulate or pelletized form and includes some material which changes color as moisture is absorbed, thereby indicating when the saturation point of the desiccant material is reached.

As shown in the drawings, tube 12 is insertable through the entire bore 26 of gun barrel 28, with the inner end 16 of tube 12 passing into firing chamber 30 of the gun. The tube is held in position within bore 26 by the attraction of the magnetic washer 24 against the muzzle end of barrel 28.

Figure 1:
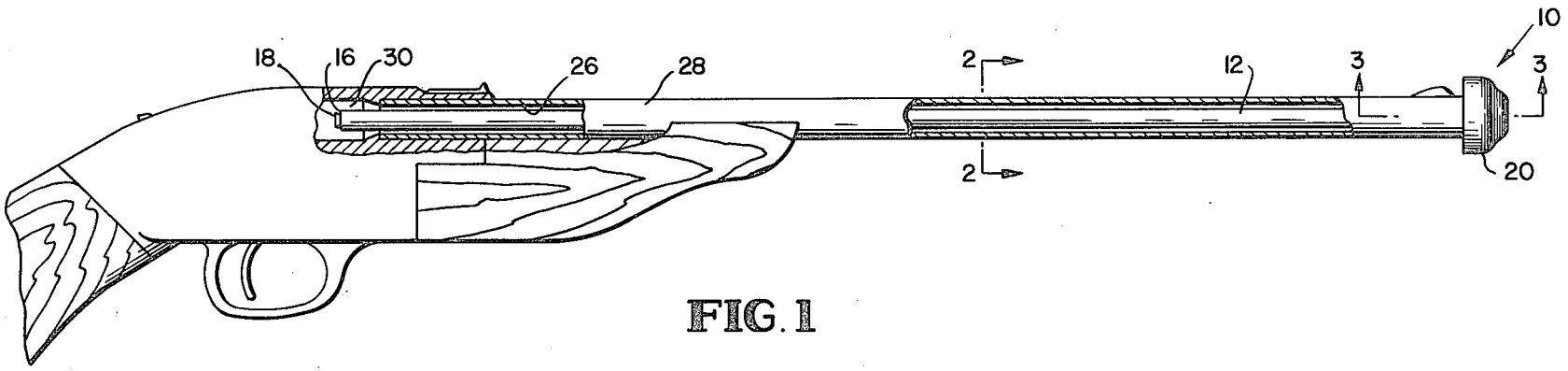
FIG. 1 is a fragmentary sectional view illustrating the desiccating device of the invention mounted in place within the barrel and firing chamber of a firearm.

With device 10 in place as shown in FIG. 1, any moisture and other vapors present within bore 26 pass through the pervious wall of tube 12 and are absorbed by the desiccant material 14. The muzzle end of barrel 28 is closed tightly by magnetic washer 24 and no moisture or dust can enter bore 26 from the surrounding environment. When desired, device 10 is removed from barrel 28 merely by pulling cap 20 away from barrel 28.

In addition, since inner end 16 of tube 12 normally extends into the firing chamber 30 accidental household shootings are eliminated. If cap 20 is in place against the muzzle end of barrel 28, one knows immediately that no bullet is in the firing chamber. Also, if after use of the gun and before storage, if one is unable to fully insert tube 12 into barrel 28 to the position of FIG. 1, it will be readily apparent that either a live bullet or spent cartridge remains in the firing chamber.

During manufacture of device 10, tube 12 may be furnished at any length, e.g. 3 feet. As mentioned above, the tube may be cut to any desired length so that it may be adapted for use with a gun barrel of any length. The tube may be of any suitable diameter, e.g. 3/16 or ¼ inch diameter, and may have a wall thickness of about 1/32 inches.

It is to be understood that the embodiment of the invention specifically described hereinabove is merely illustrative and not restrictive, the scope of the invention being indicated by the appended claims rather than by the foregoing description, and all changes and modifications which come within the meaning and range of equivalency of the claims are therefor intended to be embraced therein.

What is claimed and desired to be secured by Letters Patent is:

1. For use in a firearm having a firing chamber and a barrel with a muzzle end and a bore extending from the muzzle end to the firing chamber, a desiccating device comprising a substantially rigid, moisture pervious tubular member adapted to extend into the bore of the barrel, particulate desiccant means contained within said tubular member and adapted to absorb moisture from within the barrel, and closure means attached to one end of said tubular member and adapted to retain said member in the barrel and close the muzzle end of the barrel.

2. A desiccating device as defined in claim 1, wherein said tubular member is adapted to pass through the entire length of said bore with its other end extending into the firing chamber of said firearm.

3. A desiccating device as defined in claim 2, said closure means comprising permanent magnet means removably fastenable to the muzzle end of said barrel.

4. A desiccating device as defined in claim 2, wherein said closure means comprises closure cap means mounted on said one end of said tubular member and including permanent magnet means cooperable with the muzzle end of said barrel to retain said member within the barrel.

5. A desiccating device as defined in claim 4, comprising means closing said other end of said member, whereby said member may be cut to any desirable length for use with different sized firearms.

6. A desiccating device as defined in claim 5, wherein said tubular member is constructed of cellulose material.

7. For use in a firearm having a barrel with a muzzle end, a desiccating device comprising an elongated moisture pervious tubular member, desiccant means contained within said tubular member, closure means mounted on one end of said member and including fastening means adapted to retain said member within the barrel of a firearm, and means closing the other end of said member.

8. A desiccating device as defined in claim 7, wherein said fastening means is a permanent magnet adapted to be attracted to and to close the muzzle end of a firearm barrel.

9. A desiccating device as defined in claim 8, wherein said tubular member is constructed of cellulose material.

10. A desiccating device as defined in claim 7, wherein said tubular member is constructed of cellulose material.

* * * * *